US007901217B2

(12) United States Patent
Asai

(10) Patent No.: US 7,901,217 B2
(45) Date of Patent: Mar. 8, 2011

(54) MODULE SOCKET

(75) Inventor: Kiyoshi Asai, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 12/431,982

(22) Filed: Apr. 29, 2009

(65) Prior Publication Data

US 2009/0286410 A1 Nov. 19, 2009

(30) Foreign Application Priority Data

May 15, 2008 (JP) ..... 2008-128328

(51) Int. Cl.
*H01R 12/00* (2006.01)

(52) U.S. Cl. ..... 439/71

(58) Field of Classification Search ..... 439/71, 439/330, 78, 607, 609
See application file for complete search history.

(56) References Cited

U.S. PATENT DOCUMENTS

| | | | | |
|---|---|---|---|---|
| 6,939,172 | B2 * | 9/2005 | Lu | 439/607.2 |
| 7,086,902 | B1 * | 8/2006 | Yang | 439/607.36 |
| 7,097,466 | B2 * | 8/2006 | Asai | 439/76.1 |
| 7,179,126 | B2 * | 2/2007 | Chen | 439/607.35 |
| 7,435,139 | B2 * | 10/2008 | Yang | 439/607.01 |
| 7,594,818 | B1 * | 9/2009 | Asai | 439/71 |
| 2005/0042924 | A1 * | 2/2005 | Zhang et al. | 439/607 |
| 2006/0051986 | A1 * | 3/2006 | Asai et al. | 439/71 |

FOREIGN PATENT DOCUMENTS

| | | |
|---|---|---|
| JP | 2005-025984 | 1/2005 |
| JP | 2005-276626 | 10/2005 |
| JP | 2006-067445 A | 3/2006 |
| JP | 2006-140111 | 6/2006 |

* cited by examiner

*Primary Examiner* — T C Patel
*Assistant Examiner* — Harshad C Patel
(74) *Attorney, Agent, or Firm* — Edwards Angell Palmer & Dodge LLP; Peter C. Schechter; Catherine J. Toppin

(57) ABSTRACT

A low-profile module socket includes a socket housing, which is open at a module insertion surface and at an opposing surface, and includes peripheral wall parts and a plurality of contacts. Each contact connects at one end to a module on the inside of the socket housing and at another end to an electronic circuit substrate on the outside of the socket housing. Module securing members are formed from a metal plate and configured to contact and electrically ground a camera module provided in the socket housing. The module securing members latch at least to the pair of peripheral wall parts that oppose shield side wall parts arranged along an inner surface of the peripheral wall parts. A bottom surface plate part is formed in a single body with a pair of module securing members such that the module securing members mutually interlock at the module insertion opposing surface side.

4 Claims, 7 Drawing Sheets

MODULE SOCKET

CROSS-REFERENCE TO RELATED APPLICATION

This application claims the benefit under 34 U.S.C. §119 of Japanese Patent Application No. JP2008-128328, filed on May 15, 2008, which is hereby incorporated by reference in its entirety.

FIELD OF THE INVENTION

This invention relates to a module socket that is premounted on an electronic circuit substrate, and is in particular, to a module socket for installing a camera module used in an electronic device.

BACKGROUND OF THE INVENTION

A module such as a camera module with a built-in a photographic element must be made compact in order to make compact electronic devices such as portable telephones. Naturally, compact camera modules having advanced photographic functions are also being developed.

In order to realize advanced functionality, camera modules must nonetheless provide functions such as macro-functions that, even though small, add to volume.

Thus, when developing a camera module socket for installing a camera module in an electronic device and the like, it is preferable to have the volume of that socket be as small as possible.

Conventional camera module sockets are typically either of a surface mount type that is installed by making contact with the mounting surface of the electronic circuit substrate of the electronic device and the like; or a through hole installation type that is installed by inserting the camera module socket through a through hole opened in order to insert a camera module socket through the mounting surface of an electronic circuit substrate of an electronic device and the like, and securing the peripheral part of the related socket to the related electronic circuit substrate. Both types of camera module socket have a camera module socket bottom, and when a camera module has been installed, contacts, which have spring force and are provided on the interior bottom surface of the camera module socket, are made to have pressure contact with contact points provided on the bottom of the camera module.

For example, a conventional camera module and a camera module socket as described in Japanese Unexamined Laid-open Patent Application No. 2006-067445, are further described below as conventional example 1, with reference to FIG. 6.

The camera module 111 as illustrated in FIG. 6 constitutes a module main body 113 with a roughly cubical shape and a light receiving element built into the interior, and, provided on the upper surface side of the module main body 113, a lens part 114 for taking in photographic light in order to take photographs by forming light into an image on the light receiving element. Then, a plurality of contact pads 121 to enable transceiving electric signal data are provided on the bottom surface peripheral part of the module main body 113 on the side opposite the lens part 114. Consequently, the contact pads 121 are provided as electrical contact points capable of being in an electrically conductive state.

On both sides of one opposing pair of side surfaces of the module main body 113, cutaway parts 115 are provided such that the central part protrudes from the lens part 114 side opposite the bottom surface side, and provided on the lens part 114 side of the sides with the cutaway parts 115 are protruding parts 120 that protrude further from the side surface. The protruding parts 120 are latch protrusions for latching with the camera module socket 112.

The camera module socket 112 provides a valve-shaped hollow connector main body 122 having an open top surface. The connector main body 122 is composed of an insulative polymer resin, and comprises a bottom part 122*a* and a peripheral part 122*b* that stands up from the bottom part and forms side walls. A plurality of contact pins 124 are arranged on the four edges of the bottom part 122*a* of the connecter main body 122. These contact pins 124 are each arranged such that one end thereof can make contact with and connect to the respective contact pads 121 of the camera module 111 that is latched and secured by inserting in the camera module socket 112. Substrate securing parts 124*a*, which are the other ends of the contact pins, protrude to the outside of the connector main body 122 from holes punched in the square edge part of the bottom part 122*a* of the connector main body 122 where the contact pins 124 are located.

Further, a shield case 127, which is composed of thin metal plate and has a roughly square tubular shape, is provided on the camera module socket 112 in order to cover the outer side surface of the connector main body 122, and the shield case 127 has spring force and is formed to make a single body with the connector main body 122.

On the upper edges of the side surfaces 127*a* and 127*b* opposite to the side surfaces where the protruding parts 120 are respectively provided on the camera module 111, the shield case 127 provides spring hooks 118, which face upward and protrude outwardly. Punched in the center of these spring hooks 118 are latching holes 117, which latch with protruding parts 120 of the module main body 113. The spring hooks 118 have spring force, and when force is applied to the outside against this spring force, both spring hooks 118 mutually move to open.

Then, when the camera module 111 is inserted into the opening of the upper surface side of the camera module socket 112 formed in this way, the latch protrusions 120 press the spring hooks 118 to the outside, and by inserting further, the latch protrusions 120 enter into the latch holes 117 of the spring hooks 118. Then, when the latch protrusions 120 enter into the latch holes 117, the spring hooks 118 return to the original positions based on energized force, and the latch protrusions 120 are latched with the spring hooks 118.

At this time, the contact pads 121 of the camera module 111 are in a state of contact with the contact pins 124, which is a state of electrical continuity.

Moreover, in conventional example 1, the bottom part 122*a* is provided in order to maintain the square shape of the camera module socket 122. The bottom part 122*a* is formed in a single body with the bottom part side edge parts of the peripheral part 122*b* installed so as to be enclosed on the outside by the side surfaces 127*a* and 127*b* of the shield case 127.

Nonetheless, in conventional example 1, the substrate securing part 124*a* must be arranged on the same level as the bottom surface of the bottom part 122*a* because the electronic circuit substrate that secures the substrate securing part 124*a* of the contact 124 is positioned on the outside of the bottom part 122*a*.

Then, the bottom part 122*a*, which is composed of an insulative polymer resin, must have a specified mechanical strength in order to form a square shape together with the side surfaces 127*a*, and therefore, with a polymer resin, a thickness of about 0.3 mm is necessary. Consequently, the problem arises that use of a more low profile socket for camera modules for which compactness is desirable is prevented.

SUMMARY OF THE INVENTION

With a view to the above problem, the present invention can promote a lower profile by improving the structure of the bottom part of the module socket.

In order to address the above issues, the present invention is directed to a module socket that provides on a peripheral wall part a socket housing comprising a tubular insulator that forms a module receiving space that can receive a module, and provides multiple contacts that are supported in the socket housing, each with one end that electrically connects with a module on the inside of the socket housing and another end able to electrically connect with the electronic circuit substrate on the outside of the socket housing. In addition, the module housing further provides on the socket housing a module securing member including a metal plate, wherein a bottom surface plate part, which is formed in a single body such that shield side wall parts respectively arranged on at least a pair of facing peripheral wall parts mutually interlock, is provided on the module securing member.

Consequently, in the present invention the socket housing formed from an insulative body comprises a tubular shape, and a module securing member is provided on an opposing pair of peripheral wall parts of the tubular shape. When the module securing member provides a shield side wall part along the inner surface of the peripheral wall part from the module insertion surface across to the module insertion opposing surface, the bottom surface plate part interlocks with the pair of shield side wall parts at the module opposing surface side. Thus, the bottom surface plate part, which interlocks between the shield side wall parts, forms a bottom surface side when inserting the module.

The module socket further provides the aforementioned contacts on an opposing pair of peripheral wall parts, and the shield side wall part where the aforementioned bottom surface plate is arranged is provided on different wall parts than the wall parts where the contacts are provided.

Configured in this way, when the contacts are electrically connected with the module at the interior of the socket housing, the contacts are arranged opposing each other with the bottom surface plate part in between.

Moreover, the peripheral wall part of the module socket is formed in a square tubular shape; the peripheral wall part of one side surface of the square tube is cutaway from the module insertion surface across to the module insertion opposing surface to form roughly the shape of the Japanese character "コ"; and shield side wall parts, on which said bottom surface plate is arranged, are provided on the cutaway side surface and on the opposing surface.

Configured in this way, part of the socket housing is cut away for a light weight configuration. Moreover, by providing the shield side wall part of the module securing member on the cutaway peripheral wall part, the cutaway peripheral wall part is formed together with and is reinforced by shield side wall part.

Further, in the module socket configured as described above, the module securing member is able to ground the module by making electrical contact with the module to be received, when installed with the printed wiring board PWB, which is the mounting body.

Consequently, according to the present invention, the conventional bottom part of the socket housing formed by polymer resin, which is inferior to metal in mechanical strength, can be eliminated. Then, by substituting a bottom surface plate part formed of metal for the conventional socket housing bottom part, the shield side wall parts and the bottom surface plate part, which are latched to the peripheral wall part, can reinforce to support the tubular shape of the socket housing. Advantage is thereby taken of the mechanical strength of the metal, and strength equal to or greater than that of the conventional socket is maintained as is. Moreover, the thickness of the partial bottom surface plate part, which has the mechanical strength of metal plate, can be 0.15 mm with metal plate compared to the 0.3-mm thickness of the bottom part formed from polymer resin, and this has the effect of making the profile significantly lower than that of the conventional camera module socket.

Moreover, by lining up opposing contacts so that the bottom surface plate part is held between, the contacts can be arranged such that contact between the bottom surface plate part and the contacts does not easily occur, thus providing the effect of making accidental short circuits between the contacts and the bottom surface plate difficult to occur.

Further, even though part of the peripheral side wall that forms the socket housing is cutaway, the shield side wall parts that are interlocked with the bottom surface plate part reinforce the cutaway peripheral side parts, therefore providing the effect that the materials of the housing can be reduced thus reducing the weight of the camera module socket.

Further, by mounting and soldering the camera module socket to a printed wiring board such that the bottom surface plate part is grounded with the printed circuit board, the mounting surface on the printed wiring board is effectively increased, providing not only the effect of reliable mounting, but also of a more reliable ground.

BRIEF DESCRIPTION OF THE DRAWINGS

The inventions will become more readily apparent from the Detailed Descriptions of the Invention, which proceeds with reference to the drawings, in which FIG. 1 provides a top perspective assembly diagram illustrating the overall configuration of a module socket according to the present invention;

FIG. 2(*b*) provides a bottom perspective view of the module socket of FIG. 1;

DETAILED DESCRIPTION OF THE INVENTION

Figure 1:
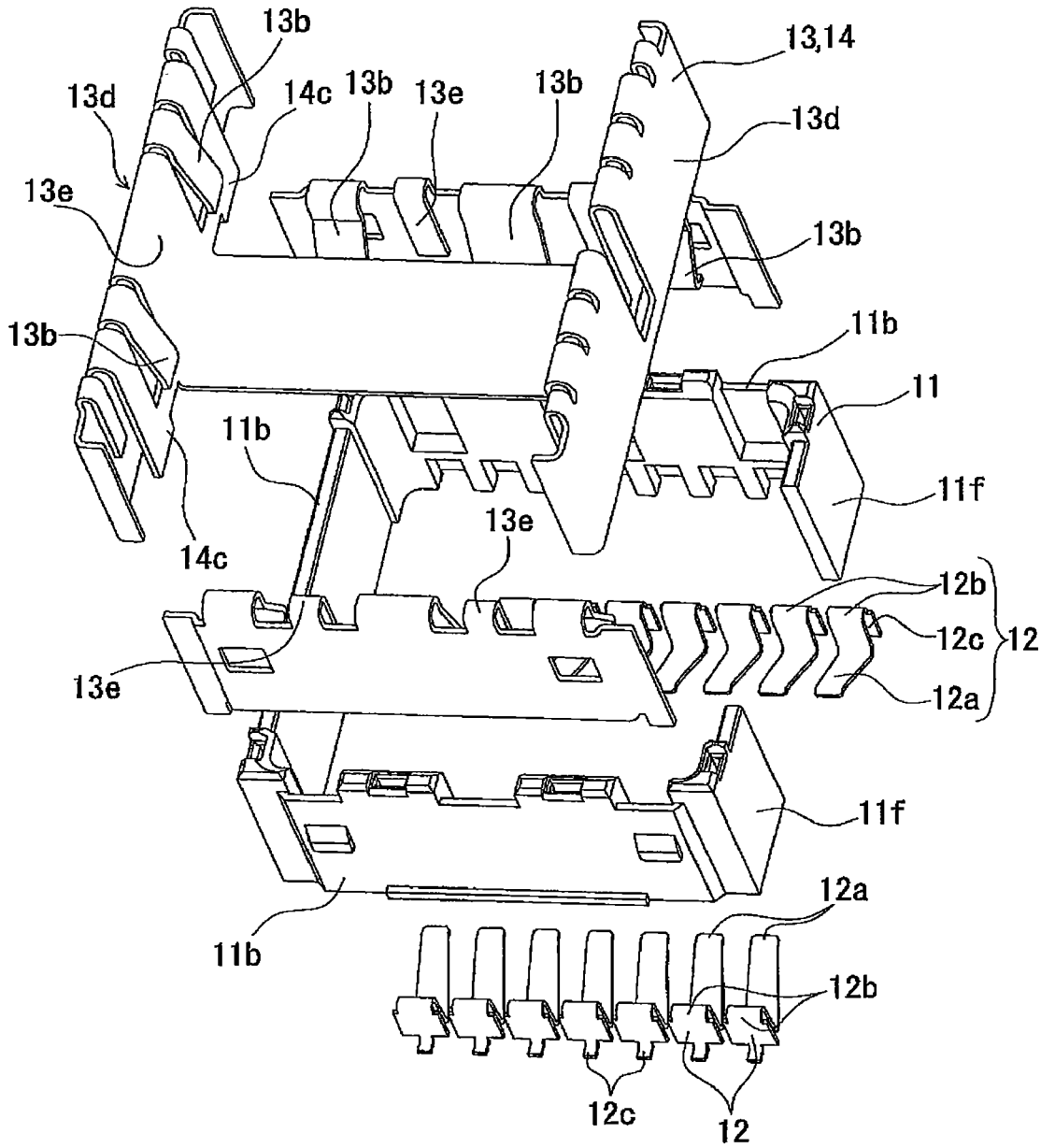

A listing of some of the reference numerals and letters that are used in the drawings, together with descriptions of the corresponding elements, are provided below:

PWB Electronic circuit substrate

15 Camera module

16 Latch protrusion

1 Module socket (socket)

11 Socket housing
- 11*a* Upper opening
- 11*b* Basket side wall
- 11*c* Contact installation hole
- 11*d* Module space
- 11*e* Bottom surface opening
- 11*f* Cutaway peripheral wall part

12 Module contact
- 12*a* Module contact part
- 12*b* Middle part
- 12*c* Substrate connection part

13 Module securing member
- 13*a* Shield part
- 13*b* Latch part
- 13*d* *Housing securing part*
- 13*e* *Securing piece*

Figure 6:
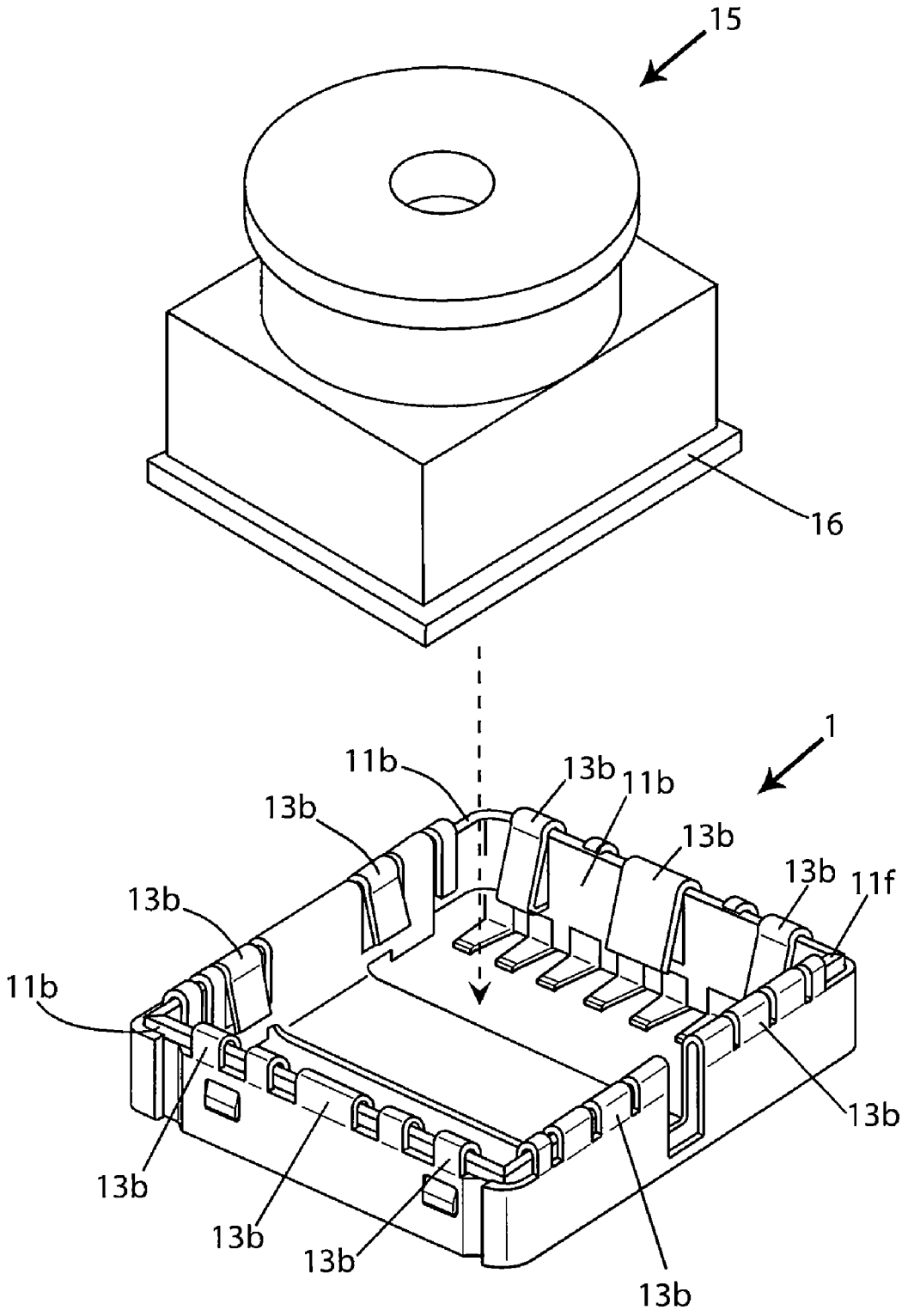
FIG. 6 provides a top perspective assembly diagram illustrating the module socket of FIG. 1 and a mating camera module FIG. 7 provides a top perspective assembly diagram illustrating a conventional camera module socket and a mating camera module.
Figure 7:
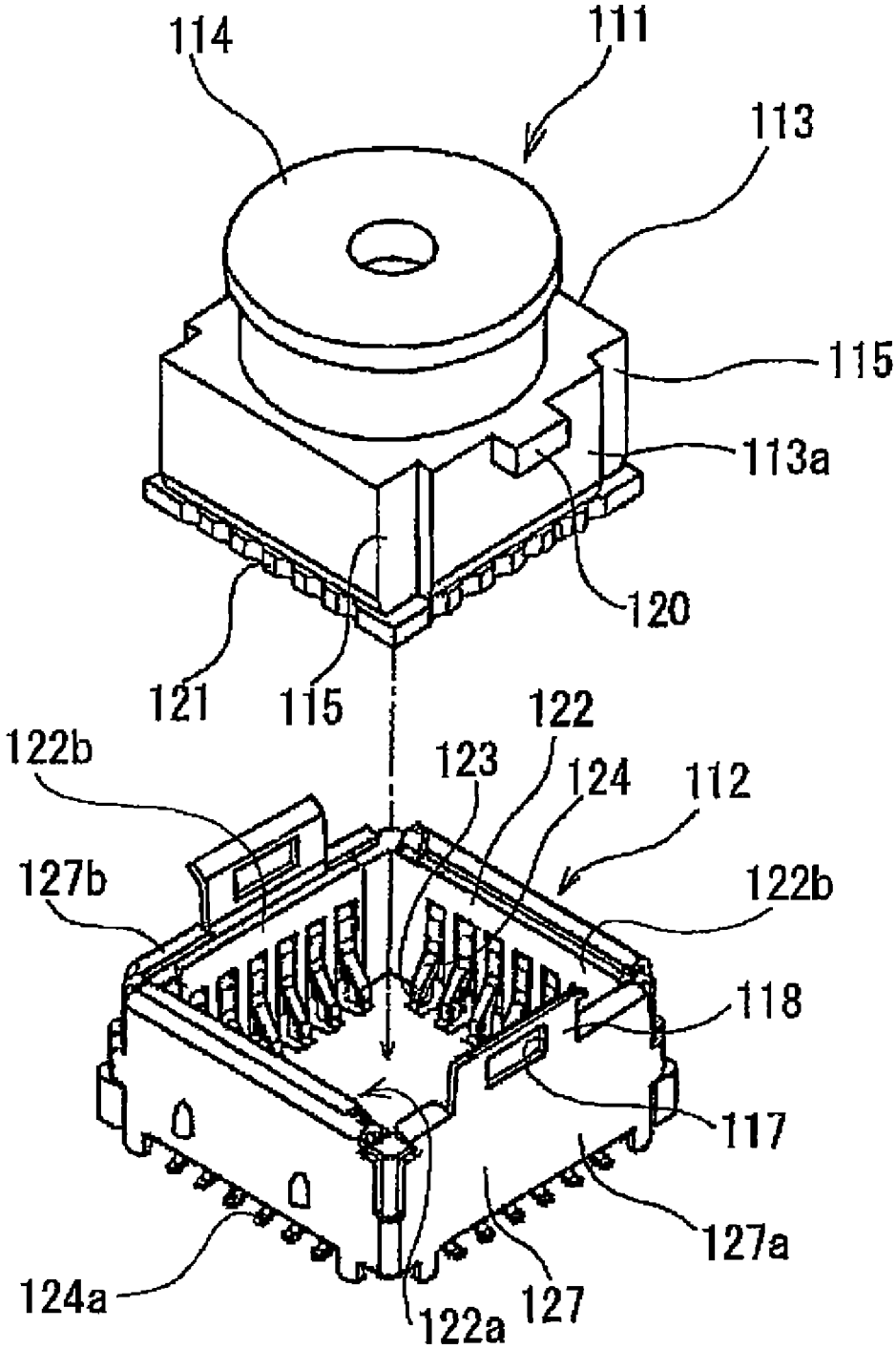
FIG. 7 (Prior Art)

14 Bottom reinforcement securing member
- 14*a* Reinforcement securing part
- 14*b* bottom surface plate part
- 14*c* Ground connection part
- 14*d* Contact shield part As illustrated for example in FIG. 6, the module socket 1 (called simply "the socket 1" below) is mated with a small-scale camera module 15 that is build into an electronic device (for example, a cellular telephone). The socket 1 includes: socket housing 11 having a square tubular shape open at one side as the upper opening 11*a*, which is the module insertion surface, and open at the surface opposing the upper opening 11*a* as the bottom surface opening 11*e*, which is the surface opposite module insertion; module contacts 12 that are installed in the socket housing 11; and module securing members 13, which mate and latch with the basket body side walls 11*b* of the socket housing 11 that are the side wall parts, make contact with the camera module 15, and ground camera module 15.

The socket housing 11 is made in a square tubular shape with open upper and bottom surfaces formed by the basket side walls 11*b* that run from the bottom surface opening 11*e* to the upper surface opening 11*a* of the socket housing 11, and is preferably formed of an insulative material such as polymer resin. Moreover, cutaway peripheral wall parts 11*f*, in which a part is cutaway from the upper opening 11*a* to the bottom surface opening 11*e*, are formed on one of the four basket side walls 11*b*. Consequently, from a top view perspective, the socket housing 11 has a shape like the Japanese character "コ" such that the cutaway peripheral wall parts 11*f* form an opening part that makes the shape of the Japanese character "コ".

A module contact 12 is formed by bending a conductive metal plate having spring force. Then, one end of the module contact 12 forms a module contact part 12*a* that is bent and rises up from the bottom surface of the socket housing 11 to the upper opening 11*a*, and a middle part is bent back into a U-shape that forms a middle part 12*b* that is secured to the basket side wall 11*b* of the socket housing 11. Moreover, the other end of the module contact 12 is formed into a substrate contact part 12*c* that protrudes from the basket side wall 11*b* side part of the socket housing 11 to the outside, and is connected and secured to the printed wiring board PWB by soldering and the like. The module contacts 12 formed in this way latch and are secured to a plurality of contact installation holes 11*c* lined up on the bottom surface opening 11*e* side of the socket housing 11. As illustrated for example in FIG. 2(*b*), two arrays of module contacts 12 are lined up on the bottom surface such that the substrate contact parts 12*c* protrude from the pair of opposing basket side walls 11*b* that do not contain the cutaway peripheral wall parts 11*f*.

Then, when the camera module 15 is inserted into the socket housing 11, the module contacts 12 make contact with contact parts provided at the bottom of the camera module 15 in positions opposite those of the module contact parts 12*a*. Consequently, a plurality of through holes for allowing the module contacts 12 to protrude out of the housing 11 are lined up as contact installation holes 11*c* on the bottom side surfaces of the socket housing 11.

The module securing members 13 mate to and latch with the basket side walls 11*b* and the cutaway peripheral wall parts 11*f* of the socket housing 11. The module securing members 13 constitute a conductive metal member such that a ground can be formed by contacting the camera module 15. Then, the module securing members 13 are able to latch with the socket housing 11 based on housing securing parts 13*d* formed on the module securing members 13 that latch with and are secured to the socket housing 11 outer surface. More specifically, provided on the housing securing parts 13*d* are securing pieces 13*e* that can hold and secure the socket housing 11, and that are bent back on the basket side wall 11*b* side along the socket housing 11 interior surface to part of the upper surface side of the socket housing 11. Moreover, formed on the housing securing part 13*d* where no securing pieces 13*e* are provided is a latch part 13*b* that bends or curves from the upper surface opening 11*a* of the socket housing 11. Then, the tip sides of the latch parts 13*b* are surrounded by the basket side walls 11*b* and the cutaway peripheral wall parts 11*f* and are formed by slanting the bottom surface opening 11*e* side to the module space 11*d* side as free edges in the module space 11*d* where the camera module 15 is received The latch parts 13*b* are positioned opposite the latch protrusions 16 provided along a lower portion the camera module 15, and can be latched with the latch protrusions 16 when the camera module 15 is received within the socket housing 11.

The latch parts 13*b* of the module securing members 13, which provide the module securing means, have spring force and can be deformed to the basket side walls 11*b* side by pressing, and then can return to the original position when the pressing force is released. Further, the securing pieces 13*e* also have the same kind of spring force, and do not easily drop out from the state of being mated into the basket side walls 11*b*.

Two module securing members 13 are each formed in an overall inverted U-shape mutually opposing a respective pair of basket side walls 11*b* that do not include the cutaway peripheral wall parts 11*f*, and are latched opposite the respective basket side walls 11*b*. Moreover, housing securing parts 13*d*, which are latched with the cutaway peripheral wall parts 11*f* and the opposing basket side wall 11*b*, are formed to mutually interlock using bottom part reinforcing securing members 14. Specifically, in the same way as the module securing members 13 and an opposing pair of basket side walls 11*b* that do not include the cutaway peripheral wall parts 11*f* are mutually latched, the bottom part reinforcing securing members 14 are formed in an inverted U-shape and constitute a reinforcement securing parts 14*a*, which latch with and are secured to the cutaway peripheral wall parts 11*f* and the opposing basket side wall 11*b*, and a bottom surface plate part 14*b* that interlocks between the reinforcement securing parts 14*a*. The reinforcement securing parts 14*a* are provided and form shield side wall parts that follow the surface of the module space 11*d* side along the basket side walls 11*b* across from the upper opening 11*a* to the bottom part opening 11*e*.

In addition, the bottom part reinforcement securing member 14 latches to the cutaway peripheral wall parts 11*f* and the opposing basket side wall 11*b* such that the upper opening 11*a* becomes a curved part with an inverted U-shape.

Moreover, the bottom reinforcement securing member 14 forms housing securing parts 13*d*, which latch and are secured to the outer surface of the socket housing 11 in the same way as the other module securing members 13. In the same way as the other module securing members 13 provided on this housing, securing parts 13*d* include securing pieces 13*e* that can hold and secure the socket housing 11 by being able to latch to the socket housing 11, and that are bent back on the basket side wall 11*b* side along the socket housing 11 interior surface to part of the upper surface side of the socket housing 11. Further, latching parts 13*b* are formed in the same way on the housing securing part 13*d* where the securing pieces 13*e* are not provided by bending or curving from the upper surface opening 11*a* of the socket housing. Moreover, regarding the bottom reinforcement securing member 14, which is latched with the cutaway peripheral wall parts 11*f* and the opposing basket side wall 11*b* respectively, interior surface side tips of the securing pieces 13*e*, which become the module space 11*d* provided on the reinforcement securing parts 14*a*, are positioned on the bottom surface opening 11*e* of the socket housing 11, and the ends of the related securing pieces 13*e* of the reinforcement securing parts 14*a* are mutually interlocked and secured by the bottom surface plate part 14*b*. Consequently, the bottom reinforcement securing member 14 has opposing reinforcement securing parts 14*a* interlocked by the bottom surface plate part 14*b*, and is formed into an H-shape when viewed from the top.

Exemplary embodiments of the present invention will be explained below with reference to the drawing figures.

Embodiment 1

Figure 2A:
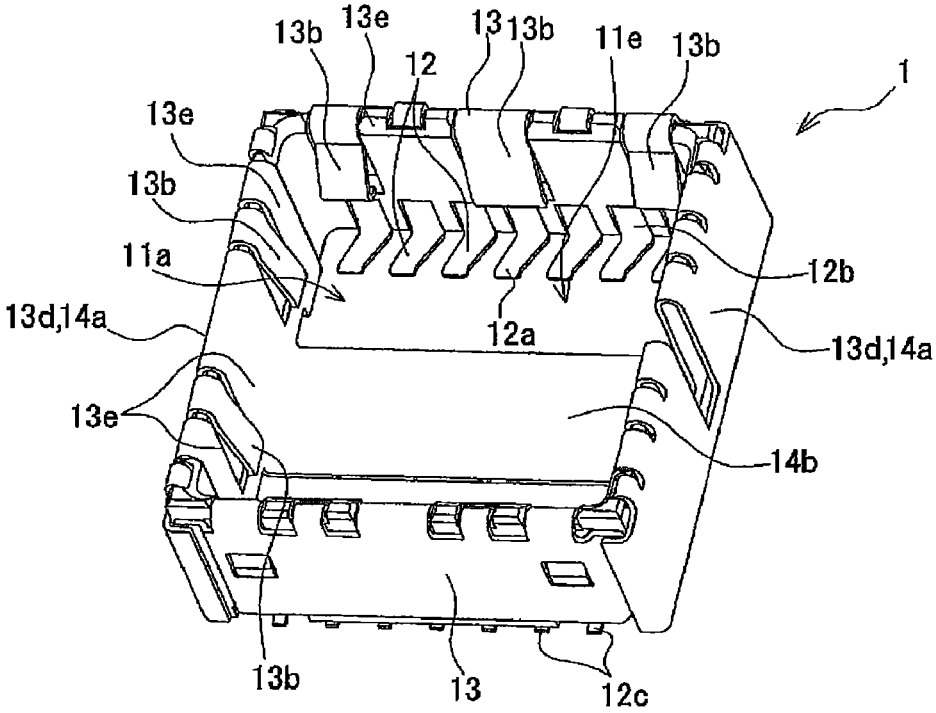
FIG. 2(*a*) provides a top perspective of the module socket of FIG. 1.
Figure 2B:
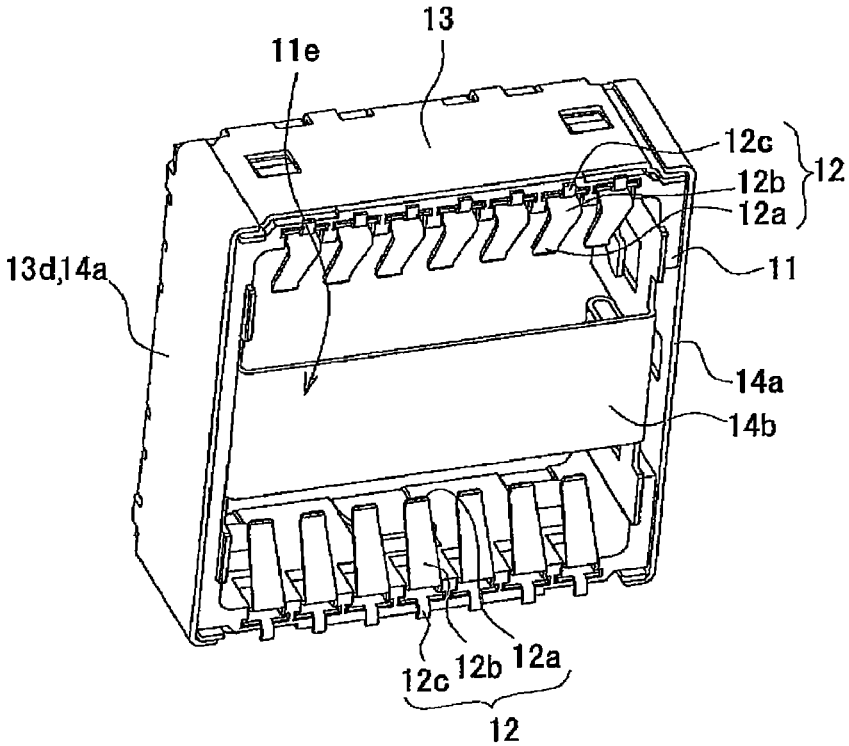
Figure 3A:
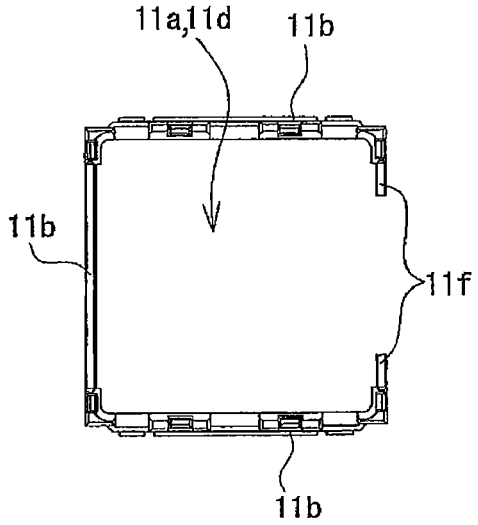
FIGS. 3(*a*)-3(*d*) illustrate a socket housing of the module socket of FIG. 1.
Figure 3B:
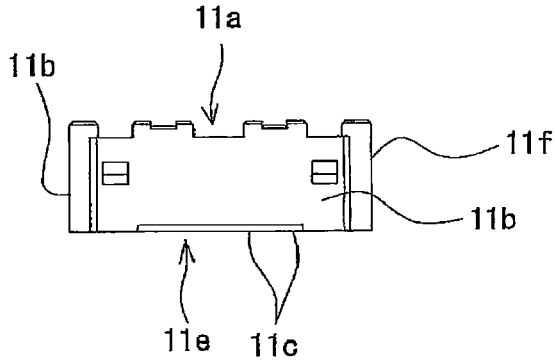
Figure 3C:
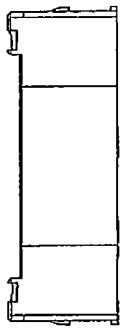
Figure 3D:
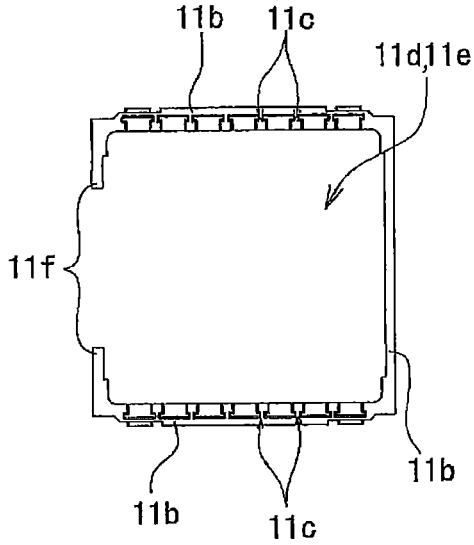

As illustrated in FIGS. 1 and 2, the module socket 1 (called simply "the socket 1" below) has a square tubular shape open at one side as the upper opening 11*a*, which is the module insertion surface, and open at the surface opposing the upper opening 11*a* as the bottom surface opening 11*e*, which is the surface opposite module insertion; and by inserting from the upper opening 11*a*, a camera module 15 is installed in an printed wiring board PWB in a state secured at the interior.

The socket 1 forms the aforementioned square tubular shape based on the socket housing 11. The socket housing 11 is preferably formed from a hard insulative material such as a polymer resin. Then, the socket housing 11 is formed by basket side walls 11*b* into a square tubular shape opened at upper opening 11*a* and bottom surface opening 11*e*. Then, contact installation holes 11*c* are bored in arrays into an opposing pair of basket side walls 11*b* on the bottom surface opening 11*e* side.

Moreover, as indicated in FIG. 3, the socket housing 11 is a square tubular shape that is open at the upper and bottom surfaces based on the basket side wall parts 11*b* that stand from the bottom surface opening 11*e* to the upper surface opening 11*a* of the socket housing 11, and is formed from an insulative material such as a polymer resin. Moreover, cutaway peripheral wall parts 11*f*, in which a part is cutaway from the upper opening 11*a* to the bottom surface opening 11*e*, are formed on one of the four basket side walls 11*b*. Consequently, from a top view perspective, the socket housing 11 has a shape like the Japanese character "コ" such that the cutaway peripheral wall parts 11*f* form an opening part that makes the shape of the Japanese character "コ".

A module contact 12 is formed by bending conductive metal plate. Then, the module contact 12 is installed such that: one end is positioned at the interior bottom surface of the socket housing 11; the middle part is inserted through the contact assembly hole 11*c* bored in the basket side wall 11*b*, and the other end is positioned to the exterior of the socket housing 11. Installed in this way, the module contact 12 is formed to be able to latch to the related assembly hole 11*c* by bending the middle part 12*b* in a U-shape opened downward at the position of the contact assembly hole 11*c*. Then, one end, which is bent from the middle part 12*b* to the bottom surface side of the socket housing 11, forms a module contact part 12*a* by bending and rising up from the bottom surface to the upper opening 11*a* side of the socket housing 11. Moreover, the other end of the module contact 12 forms the substrate contact part c, which protrudes to the outside from the basket side wall 11*b* bottom part of the socket housing 11, and connects to and is secured with the printed wiring board PWB by soldering and the like. A plurality of module contacts 12 formed in this way are lined up in two arrays on the bottom surface of the socket housing 11. Specifically, substrate connection parts 12*c* protrude from an opposing pair of basket side walls 11*b* of the socket housing 11, and the module contact parts 12*a* are provided opposite on the bottom surface at the interior of the socket housing 11. Then, when the camera module 15 is inserted into the socket housing 11, the module contacts 12 make contact with contact terminal parts on the bottom of the camera module 15, which are provided at positions opposite to the module contact parts 12*a* and can receive signals.

Consequently, when the module contacts 12 are latched and secured, the contact installation holes 11*c* provided at the bottom surface opening 11*e* of the opposing pair of basket side walls 11*b* are in a position that can be secured by soldering the substrate connection parts 12*c* of the module contacts 12 to the upper surface of the printed wiring board PWB, which is the mounting body.

Further, the module contacts 12 may be formed, for example, into any one of a number commonly used module contacts of a suitable shape.

Figure 4A:
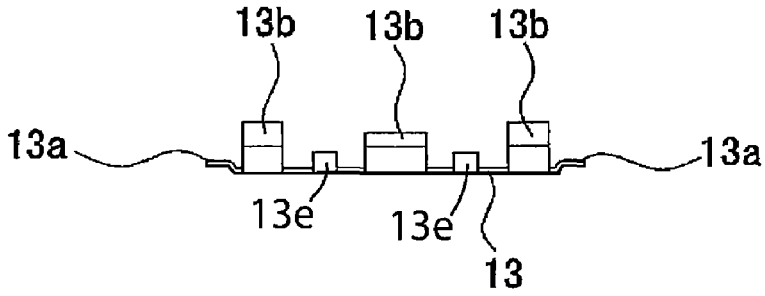
FIGS. 4(*a*)-4(*c*) illustrate a module securing member of the module socket of FIG. 1.
Figure 4B:
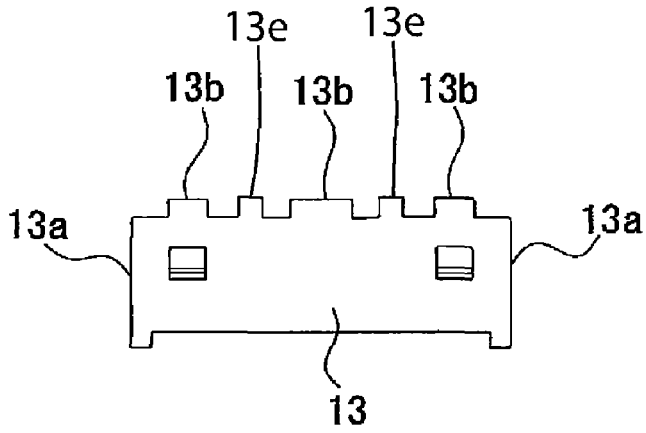
Figure 4C:
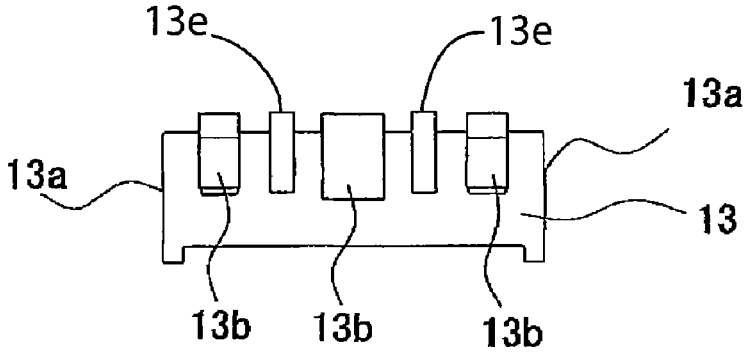
Figure 5A:
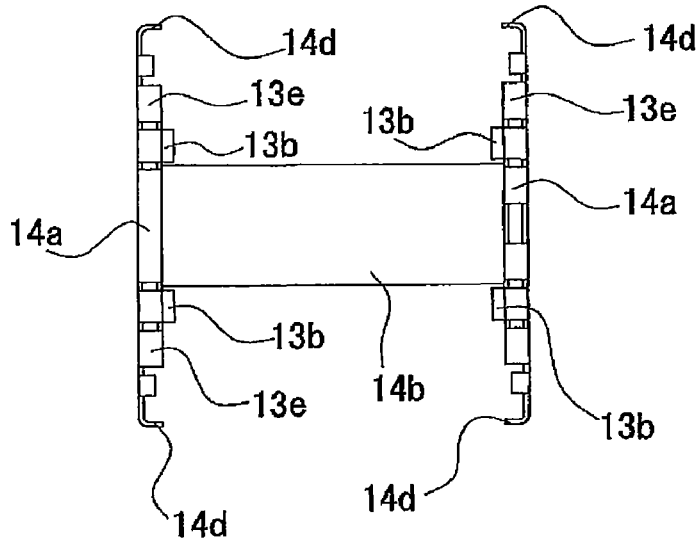
FIG. 5(*a*)-5(*c*) illustrate a bottom reinforcement securing member of the module socket of FIG. 1.
Figure 5B:
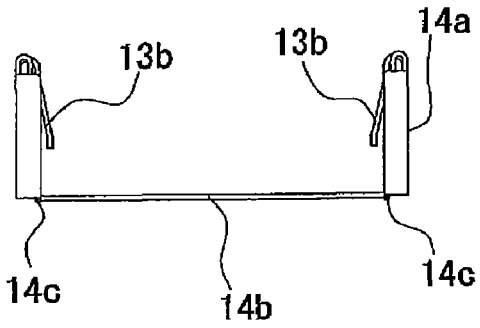
Figure 5C:
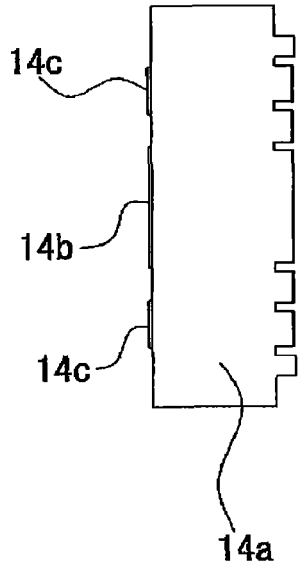

As indicated in FIGS. 1, 2 and 4, module securing members 13 mate with and are latched to the basket side walls 11*b* and the cutaway peripheral wall parts 11*f* of the socket housing 11. These module securing members 13 are composed of a conductive metal such that a ground can be formed by making contact with the camera module 15. Then, the module securing members 13 are able to latch with the socket housing 11 based on housing securing parts 13*d* formed on the module securing members 13 that latch with and are secured to the socket housing 11 outer surface. Specifically, provided on the housing securing parts 13*d* are securing pieces 13*e* that can hold and secure the socket housing 11, and that are bent back on the basket side wall 11*b* side along the socket housing 11 interior surface to part of the upper surface side of the socket housing 11. In addition, formed on the housing securing part 13*d* where no securing pieces 13*e* are provided is a latch part 13*b* that bends or curves from the upper surface opening 11*a* of the socket housing 11.

Moreover, shield parts 13*a* that can make electrical contact with the module securing members 13 that have been latched on the adjacent basket side walls 11*b* are formed on the adjacent basket side walls 11*b* side of the module securing members 13. All of the module securing members 13, which are secured and latched to the basket side walls 11*b* of the socket housing 11 that is formed in a tubular shape, enter an electrically conductive state based on the shield parts 13*a*.

Tip sides of the latch parts 13*b* are surrounded by the basket side walls 11*b* and the cutaway peripheral wall parts 11*f*, and are formed by slanting the bottom surface opening 11*e* side to the module space 11*d* side as free edges in the module space 11 where the camera module 15 is received. The latch parts are positioned opposite the latch protrusions 16 provided on the camera module 15 to be received, and can latch the latch protrusions 16 when the camera module 15 is received.

The latch parts 13*b* of the module securing members 13, which are the module securing means, have spring force and can be deformed to the basket side walls 11*b* side by pressing and then return to the original position when the pressing force is released. Further, the securing pieces 13*e* also have the same kind of spring force, and do not easily drop out from the state of being mated into the basket side walls 11*b*.

The module securing members 13 are each formed in an overall inverted U-shape mutually opposing a respective pair of basket side walls 11*b* that do not include the cutaway peripheral wall parts 11*f*, and are latched opposite the respective basket side walls 11*b*. Moreover, the module securing members 13, which are latched with the cutaway peripheral wall parts 11*f* and the opposing basket side wall 11*b*, are formed to mutually interlock using bottom part reinforcing securing members 14. Specifically, in the same way as the module securing members 13 and an opposing pair of basket side walls 11*b* that do not include the cutaway peripheral wall parts 11*f* are mutually latched, the bottom part reinforcing securing members 14 are formed in an inverted U-shape and constitute a reinforcement securing parts 14*a*, which latch with and are secured to the cutaway peripheral wall parts 11*f* and the opposing basket side wall 11*b*, and a bottom surface plate part 14*b* that interlocks between the reinforcement securing parts 14*a*.

The bottom part reinforcement securing member 14 latches to the cutaway peripheral wall parts 11*f* and the opposing basket side wall 11*b* such that the upper opening 11*a* becomes a curved part with an inverted U-shape.

Moreover, the bottom reinforcement securing member 14 forms housing securing parts 13*d*, which latch and are secured to the outer surface of the socket housing 11 in the same way as the other module securing members 13. In the same way as the other module securing members 13, provided on this housing securing parts 13*d* are securing pieces 13*e* that can hold and secure the socket housing 11 by being able to latch to the socket housing 11, and that are bent back on the basket side wall 11*b* side along the socket housing 11 interior surface to part of the upper surface side of the socket housing 11. Further, latching parts 13*b* are formed in the same way on the housing securing part 13*d* where the securing pieces 13*e* are not provided by bending or curving from the upper surface opening 11*a* of the socket housing. Moreover, regarding the bottom reinforcement securing member 14, which is latched with the cutaway peripheral wall parts 11*f* and the opposing basket side wall 11*b* respectively, the interior surface side tips of the securing pieces 13*e*, which become the module space 11*d* provided on the reinforcement securing parts 14*a*, are positioned on the bottom surface opening 11*e* of the socket housing 11, and the ends of the related securing pieces 13*e* of the reinforcement securing parts 14*a* are mutually interlocked and secured by the bottom surface plate part 14*b*. The reinforcement securing parts 14*a* are provided and form shield side wall parts such that the surface of the module space 11*d* side follows along the basket side walls 11*b* across from the upper opening 11*a* to the bottom part opening 11*e*.

Moreover, ground connection parts 14*c* are provided on the reinforcement securing parts 14*a*. The ground connection parts 14*c* are connected and secured by soldering to a ground terminal provided on the printed wiring board PWB for mounting, and the entire socket housing 11 is grounded. The ground connection parts 14*c* protrude to the printed wiring board PWB side like installation tabs on the bottom surface opening 11*e* of the module space 11*d* of the reinforcement securing part 14*a*.

Further, a member for contacting the shield part 13*a* of the adjacent module securing member 13 is formed on the reinforcement securing part 14*a* as the contact shield part 14*d*, and becomes electrically conductive by making contact with the shield part 13*a* of the module securing member 13 provided on the adjacent basket side wall 11*b*.

By providing the ground connection parts 14*c* and the contact shield parts 14*d* in this way, all of the module securing members 13 and the bottom reinforcement securing members 14 enter an electrically conductive state, and when the camera module 15 is inserted and secured, the camera module 15 has a ground connection with the printed wiring board PWB.

Consequently, the bottom reinforcement securing member 14 has opposing reinforcement securing parts 14*a* interlocked by the bottom surface plate part 14*b*, and is formed into an H-shape when viewed from the top. The bottom surface plate part 14*b* may preferably be formed from 0.15 mm thick metal plate, and therefore is thinner than the conventional 0.3 mm thickness when forming the bottom surface from resin. This difference in thickness of 0.15 mm can provide a lower profile than in the past for the socket 1, for which a low profile is desirable.

Regarding the module securing member 13 and the bottom reinforcement securing member 14 formed in this way, when the camera module 15 is inserted from the upper opening 11*a* side to the maximum depth, the tip of the opposing latching part 13*b* enters over the latching protrusion 16 by spring force, and the camera module 15 is latched and secured to the socket 1.

The contact parts (not indicated in the diagrams) provided on the bottom of the camera module 15 have satisfactory contact pressure and are connected with the module contacts 12 by the spring force of the module contact parts 11*a*.

The substrate connection parts 12*c* of the module connectors 12 are connected with the printed wiring board PWB, which is the mounting body, at a position more on the upper opening 11*a* side than in the past because a thin bottom surface plate part 14*b* is provided, and therefore when the camera module 15 has been inserted, the overall height of the camera module 15 and the socket 1 from the printed wiring board PWB is lower than in the past. For example, the overall height may be 0.15 mm lower than the height attributable to conventional designs.

Moreover, by providing the cutaway peripheral wall parts 11*f* as in the present embodiment, a lighter weight socket housing 11 can be formed than in the past, and the costs of raw materials during manufacturing can be controlled. Consequently, the expenses for metal materials generated by providing a bottom surface plate part 14*b* in association with making a low profile can be offset, and the manufacturing costs of the socket 1 in association with making a low profile can be suppressed. In a similar way, the bottom surface made of polymer resin that had a required thickness in the past is not necessary, and therefore the weight increase based on the bottom surface plate part 14*b* can also be offset because the socket housing 11 no longer has a bottom surface.

For example, the basket side wall may alternately be formed without providing a cutaway peripheral wall parts 11*f*. Moreover, the module contacts 12 may alternatively be provided on the basket side wall 11*b*, which is secured by the reinforcement securing part 14*a*, and on the cutaway peripheral wall parts 11*f*. In this case, contact assembly holes 11*c* may be formed by boring the parts of the basket side wall 11*b* secured by the reinforcement securing part 14*a* and of the cutaway peripheral wall parts 11*f* where the bottom surface plate part 14*b* is not present. Of course, the contact assembly holes 11*c* are formed in all of the basket side walls 11*b* including the cutaway peripheral wall parts 11*f* such that the module contacts 12 do not make mutual contact, and it is sufficient in any case if the module contacts 12 are latched and secured.

Those skilled in the art will readily recognize additional numerous adaptations and modifications which can be made to the present invention which fall within the scope of the present invention as defined in the claims. Moreover, it is intended that the scope of the present invention include all foreseeable equivalents to the elements and structures as described with reference to FIGS. 1-5(*c*). Accordingly, the invention is to be limited only by the scope of the claims and their equivalents.

The present invention can be utilized in camera module sockets for installing camera modules used in electronic devices.

The invention claimed is:

1. A module socket comprising:

a socket housing comprising a tubular insulator formed by peripheral wall parts and open at both ends that provides a module receiving space capable of receiving a module;

multiple contacts that are supported in the socket housing, each with one end that is configured to electrically connect to a module on the inside of the socket housing, and with another end that is configured to electrically connect with an electronic circuit substrate outside of the socket housing; and a module securing member provided on the socket housing, the module securing member including a metal plate, wherein a bottom surface plate part is formed in a single body and is provided on the module securing member, such that shield side wall parts of the module securing member respectively arranged on at least a first pair of facing peripheral wall parts mutually interlock with the bottom surface plate part, and wherein said bottom surface plate part extending transversely between said shield side wall parts, and wherein said socket housing is formed in a square tubular shape having a cutaway peripheral wall part, in which a portion of one side surface of said socket housing is cut away from the module insertion surface across to the module insertion opposing surface, and shield side wall parts, on which said bottom surface plate is arranged, are provided on the first pair of peripheral wall parts including the cutaway peripheral wall part and on opposing peripheral wall part.

2. The module socket according to claim 1, wherein said multiple contacts are provided on each of a second pair of peripheral wall parts.

3. The module socket according to claim 2, wherein one or more of the shield side wall parts of said module securing member are configured to provide ground by making electrical contact with a received module.

4. The module socket according to claim 1, wherein one or more of the shield side wall parts of said module securing member are configured to provide ground by making electrical contact with a received module.

* * * * *